US005306104A

United States Patent [19]

Witherspoon

[11] Patent Number: 5,306,104

[45] Date of Patent: Apr. 26, 1994

[54] METHOD AND WAND FOR INJECTING A LIQUID INTO THE GROUND

[76] Inventor: W. Tom Witherspoon, 537 E. Polk St., Richardson, Tex. 75081

[21] Appl. No.: 42,096

[22] Filed: Apr. 1, 1993

[51] Int. Cl.[5] ..... E02D 3/12

[52] U.S. Cl. ..... 405/263; 405/266; 405/269

[58] Field of Search ..... 405/233, 237, 238, 240, 405/263, 266, 267, 269

[56] References Cited

U.S. PATENT DOCUMENTS

| | | | |
|---|---|---|---|
| 856,786 | 6/1907 | Lamley | 405/269 X |
| 3,546,886 | 12/1970 | Jones et al. | 405/269 |
| 4,302,132 | 11/1981 | Ogawa et al. | 405/269 |
| 4,514,112 | 4/1985 | Sano et al. | 405/269 |
| 4,705,218 | 11/1987 | Daniels | 239/271 |
| 5,026,216 | 6/1991 | Koiwa | 405/267 |
| 5,141,366 | 8/1992 | Ishida et al. | 405/263 |

*Primary Examiner*—David H. Corbin
*Attorney, Agent, or Firm*—Timmons & Kelly

[57] ABSTRACT

Liquid is pumped through a specially designed wand to create a hole in the ground. The wand is pushed downward into the hole to a selected depth. The wand is then pivoted about a vertical axis through 90° during a period of five seconds. The wand is then pushed downward an additional one foot during a ten second period. The steps of the method are repeated until the wand has reached a selected maximum depth. The wand has a body with a vertical nozzle exiting through the bottom, and four horizontal nozzles exiting through side surfaces. Intermediate surfaces are interspersed between the side surfaces, giving the body of the wand a hexagonal cross section.

7 Claims, 1 Drawing Sheet

METHOD AND WAND FOR INJECTING A LIQUID INTO THE GROUND

BACKGROUND OF THE INVENTION

1. Field of the Invention

This invention relates in general to methods and apparatus for injecting liquids into the ground. In particular, the relates to a method and a wand for injecting a liquid into the ground in order to stabilize the soil.

2. Description of the Prior Art

Liquids are injected into the ground for many different reasons. For many years lime has been injected into the ground in order to stabilize clayey soils. A combination of water and sulfuric acid may also be injected into a soil for stabilization. Clay is very expansive, and can be destructive to overlying structures, if it is not stabilized.

As an alternative to stabilization, water may be injected into a clayey soil to pre-swell the soil. The pre-swollen soil will not expand later.

Another liquid that is sometimes injected into the ground is grout. Grout may be injected into a clayey or sandy soil to harden and reduce the permeability of the soil.

SUMMARY OF THE INVENTION

The general object of the method and the apparatus of the invention is to inject a liquid into the ground. In general, this object is accomplished by using an injection pump to pump a liquid through a uniquely designed wand. The wand has an insection port on the bottom and four injection ports on the sides at 90° intervals.

The method of the invention involves pushing the wand down to a selected level, then pivoting the wand through 90°0 in a period of five seconds. Then, the wand is pushed downward another foot during a period of ten seconds, and pivoted another 90°0 in a period of five seconds. The steps of the method are repeated until the wand reaches a selected maximum depth.

The above, as well as additional objects, features, and advantages of the invention will become apparent in the following detailed description.

DESCRIPTION OF THE PREFERRED EMBODIMENT

Figure 1:
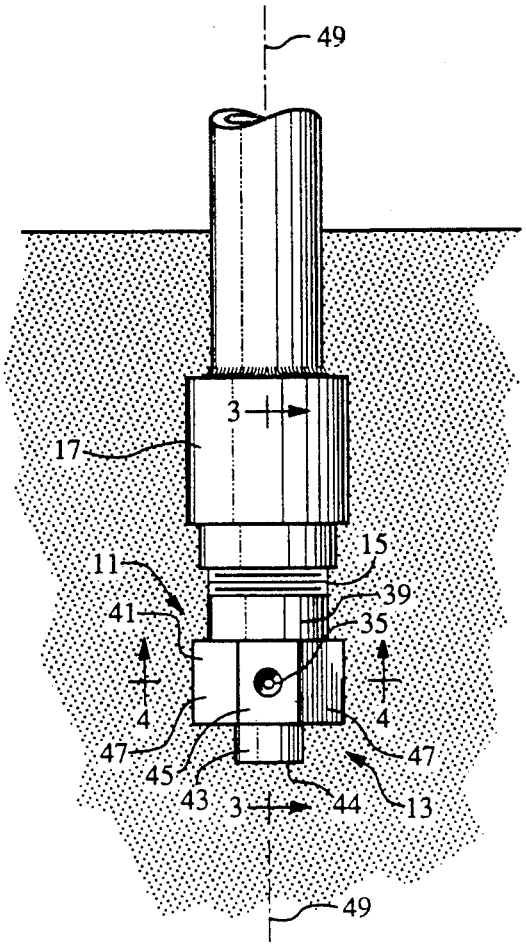
FIG. 1 is a side elevation of a wand according to the invention.

The wand 11 of the invention is shown in the drawings. The body 13 of the wand 11 has connection means, such as external threads 15, for connecting the wand 11 to a conduit 17. The conduit 17 is, in turn, connected to an injection pump (not shown) of a type well known in the art. The injection pump can pump a liquid through the conduit 17 to the wand 11.

The body 13 of the wand 11 has a central bore 19, collinear with the bore 21 of the conduit 17. The central bore 19 of the wand 11 connects to a vertical nozzle 23 exiting downward through the bottom of the body 13 of the wand 11. Liquid flowing through the conduit 17 and the wand 11 can exit the wand 11 through the vertical nozzle 23. The vertical nozzle 23 has a cylindrical bore 25 and a conical exit 27. The angle 29 of the conical exit 27 is about 40°.

The body 13 of the wand 11 also has four horizontal nozzles 31. The horizontal nozzles 31 connect to the central bore 19, and each horizontal nozzle 31 has a cylindrical bore 33 and a conical exit 35. The angle 37 of the conical exit is about 20°. The four horizontal nozzles 31 are evenly spaced at right angles relative to one another.

Figure 3:
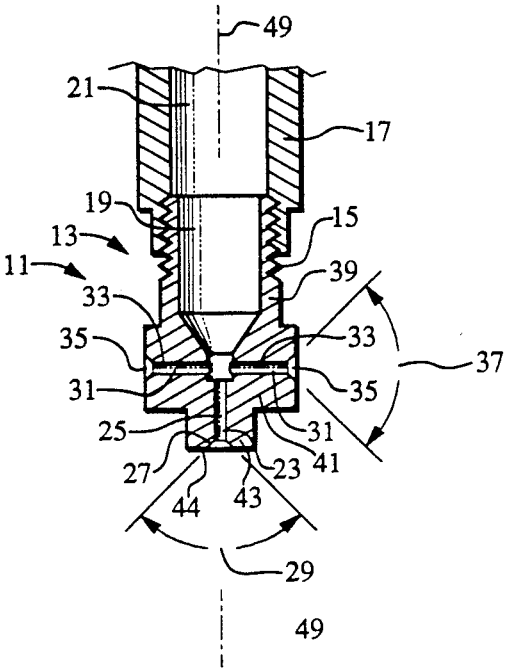
FIG. 3 is a sectional view of the wand of the invention, as seen along lines 3—3 in FIG. 1.
Figure 2:
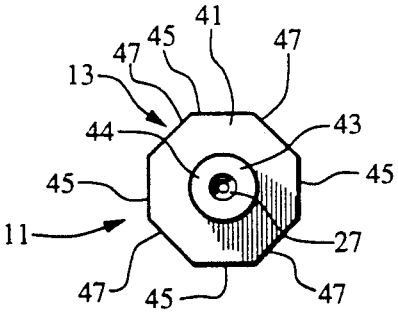
FIG. 2 is a bottom plan view of the wand according to the invention.

The body 13 of the wand 11 has three sections below the threaded connector 15. Immediately below the threads 15 is a circular upper section 39. Directly below the upper section 39 is a hexagonal section 41. The lowest section 43 of the body 13 is another circular section 43. The bottom 44 of the lower section 43 is flat and circular, as seen in FIGS. 1–3.

Figure 4:
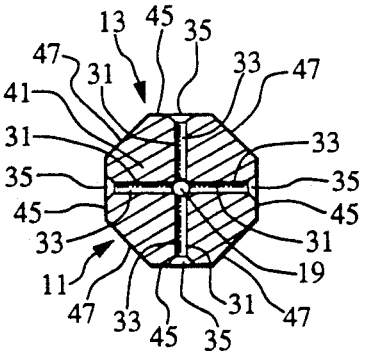
FIG. 4 is a sectional view of the wand of the invention, as seen along lines 4—4 in FIG. 1.

As shown in FIG. 4, the hexagonal section 41 of the body 13 has an equilateral hexagonal cross section. The section 41 thus has four flat side surfaces 45 and four flat intermediate surfaces 47 interspersed between the side surfaces 43.

Each of the four horizontal nozzles 31 exits through one of the side surfaces 45, since the horizontal nozzles 31 are situated at right angles to one another. The vertical nozzle 23 exits through the bottom 44 of the wand body 13.

When the injection pump forces liquid through the wand 11, the liquid will be sprayed downward through the vertical nozzle 23 and laterally through the horizontal nozzles 31. The pressure and the spray action of the liquid will wash out a hole in the soil, allowing the wand 11 to be pushed downward into the hole. The first step of the method of the invention is pumping the liquid through the wand 11 to create a hole in the ground.

The wand 11 is then pushed downward to a selected depth. The selection of this initial depth is established by prior testing of the soil. The wand 11 is pushed downward at a rate of about ten seconds per foot.

When the wand 11 has reached the selected initial depth, the downward movement of the wand 11 is stopped. The wand 11 is then pivoted about a vertical axis 49 through the wand 11. The wand 11 is pivoted through a selected angle in a selected time period. In the preferred embodiment, the wand 11 is pivoted through 90° during a five second period.

The downward movement of the wand 11 is then resumed. The wand 11 is pushed downward an additional distance during a selected period of time. In the preferred embodiment, the wand is pushed downward one foot during a period of ten seconds. However, this rate may be varied if it is seen that the liquid returns up the hole outside of the conduit. If this happens, the rate can be increased accordingly.

The steps of the method are repeated until the wand 11 reaches a selected maximum depth. The maximum depth is determined by prior testing of the soil.

In most situations, a single hole will be insufficient to provide adequate coverage. The method of the invention can be repeated in an additional holes offset from the first hole. Each additional hole will preferably be about three feet from the adjacent holes.

The method and the apparatus of the invention have several advantages over the prior art. The method and apparatus of the invention provide increased coverage of the soil. The method and apparatus of the invention are economical and efficient for use in injecting liquids into the ground.

The invention has been described in only one embodiment. It should be apparent to those skilled in the art that the invention is not so limited, but is susceptible to various changes and modifications without departing from the spirit of the invention.

I claim:

1. A method for injecting a liquid into ground soil, comprising the steps of:

(a) conducting a soil test at the contemplated site of liquid injection to determine soil depths at which injection of liquid is to be stopped;

(b) providing a portable hand holdable wand;

(c) providing a source of pressurized injection liquid to said wand;

(d) effecting a flow of the liquid received from said source through said wand while gradually inserting said wand into the ground at said contemplated site to create a hole in the ground;

(e) while liquid is being injected into said hole continuing to gradually insert said wand into the ground thereat to an increasing depth until the wand reaches a first of said predetermined depths;

(f) stopping insertion of the wand at a first of said predetermined depths;

(g) pivoting the stopped wand through a selected angle about a vertical axis in a selected time period;

(h) inserting the wand increasingly downward into the ground a selected distance beyond said predetermined depth; and (i) repeating steps (f) through (h) a selected number of times for subsequent predetermined depths until a selected maximum ground penetration is achieved.

2. A method for injecting a liquid into the ground as recited in claim 1, wherein in step (g) the wand is pivoted through 90° about a vertical axis.

3. A method for injecting a liquid into the ground as recited in claim 1, wherein in step (g) the wand is pivoted in a period of five seconds.

4. A method for injecting a liquid into the ground as recited in claim 1, wherein in step (h) the wand is pushed downward one foot.

5. A method for injecting a liquid into the ground as recited in claim 1, further comprising the step of repeating steps (d) through (i) to create a second hole at a selected distance from the first hole.

6. A method for injecting a liquid into the ground as recited in claim 5, wherein the second hole is approximately three feet from the first hole.

7. A method in accordance with claim 1 in which at least said steps (f) through (h) are conducted sequentially.

* * * * *